United States Patent [19]

Lyngdorf et al.

[11] Patent Number: 4,783,820

[45] Date of Patent: Nov. 8, 1988

[54] LOUDSPEAKER UNIT

[76] Inventors: Johan P. Lyngdorf, Arnakvej 8, DK-8270 Höjbjerg; Jorgen S. Stokholm, Rismosevej 29, DK-8260 Viby J., both of Denmark

[21] Appl. No.: 29,677

[22] Filed: Mar. 24, 1987

Related U.S. Application Data

[63] Continuation-in-part of Ser. No. 816,111, Jan. 3, 1986, abandoned.

[30] Foreign Application Priority Data

Jan. 3, 1985 [DK] Denmark ..... 26/85

[51] Int. Cl.[4] ..... H04R 1/02

[52] U.S. Cl. ..... 381/89; 381/195; 181/145

[58] Field of Search ..... 381/88, 89, 90, 188, 381/195, 205; 181/145

[56] References Cited

U.S. PATENT DOCUMENTS

| | | | |
|---|---|---|---|
| 2,002,390 | 5/1935 | Crosley, Jr. et al. | 381/89 |
| 2,768,702 | 10/1956 | Lowry | 381/89 |
| 2,872,516 | 2/1959 | Hoffman | 381/89 |
| 3,688,864 | 9/1972 | Guss | 381/89 |
| 4,268,719 | 5/1981 | Manger | 381/89 |
| 4,472,605 | 9/1984 | Klein | 381/89 |

*Primary Examiner*—Forester W. Isen

*Attorney, Agent, or Firm*—Antonelli, Terry & Wands

[57] ABSTRACT

For a good and efficient sound reproduction from a loudspeaker unit it is prescribed that two woofers are arranged back to back, one on a front plate of the unit and the other on an internal partion plate, whereby a front compartment of the unit operates as an effective bass reflection system, while a closed rear compartment contributes, via the rear loudspeaker, to improve the quality of the reproduced sound. The back to back arrangement of the two loudspeakers results in a non-vibrating unit.

8 Claims, 4 Drawing Sheets

LOUDSPEAKER UNIT

This application is a continuation-in-part of U.S. application Ser. No. 816,111, now abandoned.

BACKGROUND OF THE INVENTION

The present invention relates to a loudspeaker unit, particularly for reproduction of sound of low frequences, although such a unit may of course also be equipped with one or more drivers for higher frequences.

It is a traditional problem that a base loudspeaker, for correctly reproducing the low sound frequences, should be mounted on an extremely large baffle plate in order to prevent the air pressure variations at the front side of the loudspeaker diaphragm from being more or less suppressed by the opposite or counter phase air pressure variations as occurring at the rear side of the diaphragm. The practical solution of this problem is the use of a box structure having a front wall, on which the loudspeaker is mounted, and the resulting loudspeaker unit may be either of the closed type, in which the box or cabinet is entirely closed, or of the so-called bass reflection type, in which the box has an opening spaced from the loudspeaker, whereby the "rear slide sound" of the loudspeaker is radiated through said opening or acoustic port without giving rise to considerable counter phase problems. These two basic solutions each show certain advantages and certain disadvantages as to the quality and the volume of the reproduced sound. Thus, the closed systems are known to produce a high sound quality, while the bass reflection systems are known to be of a high efficiency.

Another traditional problem is that for achieving a high sound volume or intensity it is necessary to use a large and rather expensive loudspeaker, and it is well known that a cheaper and otherwise more convenient solution may be to use two smaller loudspeakers. These may both be mounted on the front plate of the cabinet whereby they operate acoustically in parallel, without requiring any very large width of the front plate, or they may be mounted one behind the other in a so-called compound system, in which they operate acoustically in series. An associated problem, however, is that the combined moved masses of the two drivers is relatively high, whereby the entire unit is subjected to pronounced mechanical vibrations, which may very well lead to a displacement and a fall down of a loudspeaker unit placed e.g. on a shelf.

The present invention has for its purposes to provide a loudspeaker unit in which two loudspeakers for low frequency reproduction are arranged in a novel and advantageous manner.

According to the invention the two loudspeakers are arranged, as already known, one behind the other, but connected so as to operate in counter phase, one loudspeaker being mounted on the front plate of the cabinet and the other loudspeaker being mounted on an internal partition plate inside the cabinet, said partition plate dividing the cabinet in a front chamber, which is provided with an acoustic port, and a rear chamber, which is basically a closed chamber. With this arrangement the diaphragms of the two loudspeakers will cooperate to produce the air pressure variations in the said front chamber and thus condition the latter to function as a very effective bass reflection system, with the front loudspeaker still radiating the sound in a direct manner from the front side of its diaphragm. The diaphragm of the rear loudspeaker will work rearwardly into the rear closed chamber, whereby the diaphragm is influenced by the associated operation conditions of a closed system, as normally providing for a high quality of the sound reproduction due to an effective reproduction of even very low frequences. This implies that the contribution of the rear loudspeaker to the sound production in the front chamber will be adjusted to an improved sound quality as compared with the front loudspeaker, and the result will be a loudspeaker unit or system, which is a highly effective bass reflection system capable of reproducing the sound with a remarkably improved sound quality.

Another remarkable advantage of the system according to the invention is that the two loudspeakers as placed one behind the other and operating in counter phase, geometrically, will dynamically outbalance each other, such that the resulting mechanical vibrations of the entire unit will be very small if not totally eliminated.

In a preferred embodiment the two loudspeakers are oriented back to back, i.e. with their rear magnetic systems facing each other, and a rigid mechanical connection is established directly between the magnetic systems, whereby practically no vibrations are transferred to the respective mounting plates of the cabinet. It will be readily understood by those skilled in the art that it is hereby even possible to make use of loudspeakers having a mechanically rather weak chassis located between the magnetic system and the outer chassis rim portion as supporting the other edge of the diaphragm and being used for securing the loudspeaker to its mounting plate, i.e. the loudspeakers may even be of a relatively cheap construction.

When the two loudspeakers are stabilized by means of the said rigid interconnection the outer rim portions of the loudspeaker chassises should not necessarily be rigidly fastened to the respective mounting plates, and according to the invention, therefore, the loudspeaker sub unit as constituted by the two interconnected loudspeakers may advantageously be mounted in the cabinet by the intermediate of resilient holding means interposed between the outer chassis rim portions of the loudspeakers and the edges of the respective holes in the mounting plates. Hereby any possible resulting vibrations of the said loudspeaker sub unit will be absorbed by the resilient holding means, such that the entire unit will be practically completely non-vibrating.

The present invention further relates to a loudspeaker system of the so-called compound type, i.e. in which two principally similar loudspeakers cooperate to reproduce the same frequency range, such that relatively large volumes of air are to be oscillated. Bass loudspeakers are usually rather large units for fulfilling this purpose, but for various reasons that are practical and economical limitations as to their size, just as very large loudspeakers will require correspondingly broad loudspeaker cabinets. These problems may be overcome with the use of doubled loudspeakers, which, already by their mounting side by side or above each other may account for a more suitable shape of the loudspeaker cabinet than with the use of a single loudspeaker of the same, combined diaphragm area, just as such a single loudspeaker will normally, when made with a high quality, be more than twice as expensive as each of the two singular loudspeakers.

The two cooperating loudspeakers may be arranged in two principally different manners for achieving two different sets of advantages. With the said arrangement of the loudspeakers side by side or in parallel a large total diaphragm area will be achieved and therewith a high efficiency, but the cabinet shall have to be correspondingly large, and thus the main effect is an increase of the efficiency of the loudspeaker unit. It is well known that with the use of bass loudspeakers some—normally accepted—distortion phenomina occur near the relevant resonance frequency as a consequence of the effect onto the rear side of the diaphragm of the air vibrations inside the cabinet, and this effect will not be changed with the use of two loudspeakers mounted side by side in the cabinet.

In a "genuine" compound system use is made of another possibility, viz. by arranging the two loudspeakers acoustically in series, i.e. one behind the other, with the space between the loudspeakers closed by means of a cylinder extending between the opposed peripheries of the respective two loudspeaker diaphragms. The diaphragms will move forwardly and rearwardly in phase with each other, whereby the foremost diaphragm will not meet with any air spring effect from the inside, i.e. the foremost, front radiating loudspeaker may work with a high efficiency and thus produce a more powerfull bass than a corresponding singular loudspeaker, though less powerfull than with the use of two loudspeakers arranged in parallel. The cabinet is connected with but a single rear side of the diaphragm, i.e. the cabinet may be as small as adapted to only a single loudspeaker.

Besides, the said distortions as due to influence onto the diaphragm side in contact with the air of the cabinet, will occur only at the rear diaphragm, because they are only to a very small extent transferred to the foremost, front radiating diaphragm through the restricted air space between the diaphragms. Thus, both a relatively non-distorted and yet rather strong bass reproduction may be obtained, even with the use of a relatively small cabinet.

However, both of the said systems, which are used all according to the desired sets of advantages, show a common substantial drawback, viz. that the cabinet is subjected to quite considerable oscillations from the oscillating systems of the loudspeakers, this giving rise to high requirements with respect to the construction and the anchoring of the cabinet.

It is a purpose of the invention to provide a loudspeaker system of the component type, in which the oscillations of the cabinet can be eliminated regardless of the loudspeakers being mounted in series or in parallel, and in which a good efficiency is achievable.

According to the invention the two loudspeakers are mounted back to back, i.e. with their associated magnet systems facing each other and coupled together in a mechanically rigid manner, while their voice coils are connected to oscillate in mutual counterphase, such that in operation type will move towards and away from each other. An immediate result is that the loudspeaker or driver unit as such will not transfer noticeable oscillations to the cabinet, inasfar as noticeable resulting oscillations will simply not be created by the counterphase motion of the movable parts of the respective loudspeakers, when these are similar in the relevant manner. Another achievable advantage is that the rear sides of the magnet systems, when mounted close to each other, may affect each other magnetically such that with a uniform polarity in the two systems the said rear sides will be mutually repellant due to the stray flux adjacent and outside the rear sides. It is already a known fact that it is advantageous to mount an inversely polarized magnet at the rear side of the magnetic system of a loudspeaker, as the resulting repulsion will intensify the magnetic field at the front or operative end of the magnetic system, i.e. in the annular gap, in which the voice coil operates. It will be appreciated that in accordance with the invention there is not just added a magnet, but the magnetic system of an extra loudspeaker, whereby the two loudspeakers affect each other to increase both of the operative magnetic fields adjacent the voice coils, without the use of separate, extra magnets for that purpose. With a correct polarization of the two magnetic systems it will thus be obtained as an additional advantage that the efficiency of both loudspeakers will be increased.

The said building together of the loudspeakers back to back may be applied regardless of whether they should operate, acoustically, in series or in parallel. In the two instances, however, different acoustic connections should be provided, and the two situations should here be commented upon separately.

1. Series Connection. Here advantage is taken of the fact that the space behind the front radiating diaphragm will expand and contract in synchronism with the corresponding respective contraction and expansion of the space behind the rear diaphragm by the counterphase movements of the voice coils, i.e. with a suitable shielding and mutual connection of these spaces a closed chamber may be provided, in which the air can pulsate in an alternating manner without showing any substantial air spring action on the diaphragms. The sound will still be radiated from the front side of the front diaphragm, while the effective acoustic connection between the combined loudspeaker unit and the interior of the cabinet exist at the front facing side of the rear diaphragm and not as in the prior art at the rear side of the diaphragm, as this side is now cooperating with the said closed chamber.

The flow connection between the space behind the front diaphragm and the space behind the rear diaphragm may well be established through external channel means, but it is a special feature of the invention that it is possible to use a central channel, inasfar as the central portions of the adjacent magnetic systems may be shaped in a tubelike manner, such that the air may flow directly through the central magnetic system itself.

2. Parallel Connection. Here the movements of the rear diaphragm should be transmitted forwardly to support the radiation from the front side of the front diaphragm, i.e. in phase therewith. Due to the counterphase coupling it will be the space behind the rear diaphragm which will acoustically correspond to the space in front of the front diaphragm, and the parallel connection, therefore, can be established by isolating or shielding the space behind the rear diaphragm and connecting it through a sound channel to the front side of the cabinet, while the cabinet chamber is in open connection with the rear side of the front diaphragm and the front side of the rear diaphragm, respectively. In a preferred embodiment use is even here made of the said tubelike design of the magnetic systems of the loudspeakers, this tube being at disposal as the said sound channel, when also the front diaphragm is open or apertured in its associated middle area. The sound from the rear loudspeaker will thus be front radiated through a middle hole in the diaphragm of the front loudspeaker, whereby a certain attenuation of the sound will occur when compared with the front radiation of an extra, front mounted loudspeaker, but the sound nevertheless originates from the space behind the entire rear side of the rear diaphragm, i.e. the sound energy of the air will be considerably higher than the energy radiated by a diaphragm just having the size of the said central aperture of the front diaphragm.

In the following the invention is described in more detail with reference to the drawing, in which:

DETAILED DESCRIPTION

Figure 1:
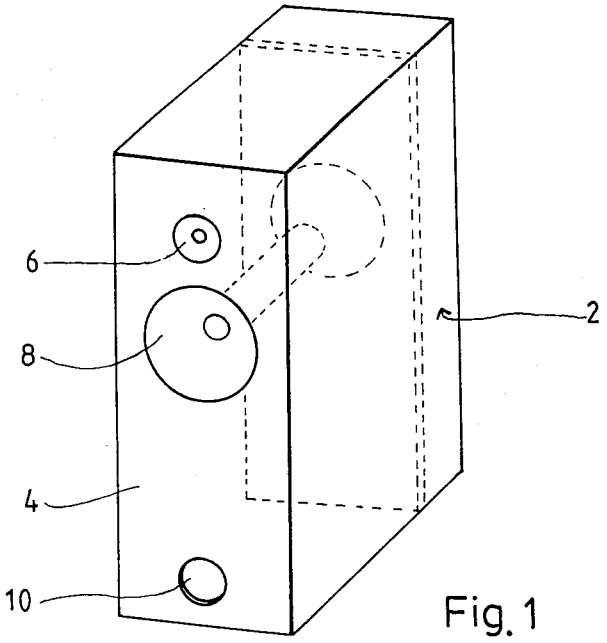
FIG. 1, is perspective view of a loudspeaker unit according to the invention.
Figure 2:
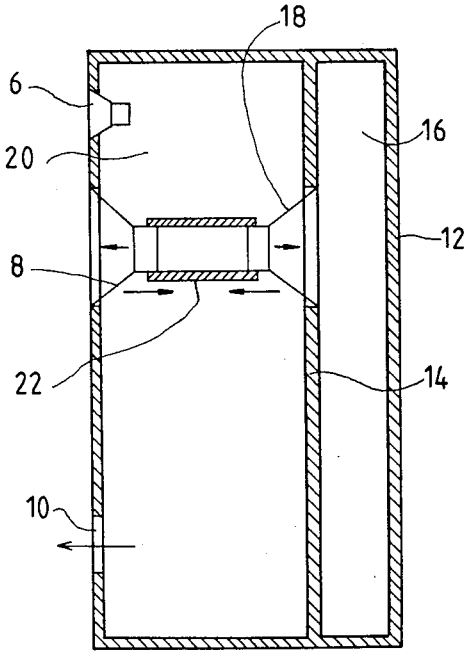
FIG. 2 is a cross sectional view thereof.

The loudspeaker unit shown in FIGS. 1 and 2 comprises a cabinet box 2 having a front plate 4, on which, near the top thereof, is mounted a tweeter 6. Just underneath the tweeter 6 is mounted a woofer 8, which is a combined driver for the bass and the middle tone frequences, while well below the woofer 8 the front plate 4 is provided with an acoustic port 10.

The rear wall of the cabinet is designated 12, and in front of this wall is mounted an intermediate partition plate 14, which, together with the rear wall 12, confines a closed rear chamber 16 of the cabinet. On the partition plate 14 and just behind the woofer 8 is mounted another, corresponding woofer 18, which in the example shown is mounted rearwardly radiating and thus forwardly projecting into a chamber 20 common to both drivers 8 and 18 and located between the front plate 4 and the partition plate 14. The two woofers are mutually rigidly connected through a connector tube 22, which is arranged between the respective magnet systems 23 of the woofers and is stiff against both axial compression and axial pulling forces. The connection 22 should not necessarily consist of a closed tube, which will occupy a certain volume of the common chamber 20; by way of example, one or more thin rods or a cross profiled connector element may be used instead of a closed tube.

The woofers 8 and 18 are coupled, geometrically, in counter phase, such that their respective diaphragms will move concurrently towards and away from the common chamber 20. The front woofer 8 will radiate the sound direct from the front plate 4 and will at the same time, together with the rear woofer 18, transmit the same sound to the common chamber 20, though here in counter phase relative the directly radiated sound. However, since the acoustic port 10 is located substantially spaced, e.g. some 50 cm, from the front woofer 8, the sound as transmitted through this port will be substantially in phase with the directly radiated sound, and test have shown that the total result is a good sound quality or sound picture seeming to originate from a single sound source, despite the said distance between the woofer and the acoustic port.

If desired one or more addtional pairs of woofers may be mounted in the cabinet, whereby the loudspeaker unit may operate with very high effects from frequences even up to some 2–4 kHz and with a very good bass reproduction without any expensive large diameter bass loudspeaker having to be used.

Advantageously an acoustic damping material may be laid into the rear chamber 16 as well as into one or more partial areas of the chamber 20, but it is deemed unnecessary to describe this in more detail here.

The driver 18 may optionally, be mounted in an inverted position on the partition plate 14, whereby it will produce an increased amount of sound energy to the chamber 20. However, it is then correspondingly more difficult to provide the rigid connection 22 between the two drivers.

The rear chamber 16 should not necessarily be a regular box space extending over all the height and width of the cabinet, but it will be appreciated that with the illustrated regular design of the chamber 16 the space or volume of an overall simply designed cabinet will be advantageously utilized.

The sub unit consisting of the two loudspeakers 8 and 18 and the rigid connection 22 therebetween will be mountable in the cabinet by insertion into the respective mounting holes in the plates 4 and 14, and the outer rim portions of the chasis of the loudspeakers will hereby be holdable in the holes by intermediary of respective resilient ring members 24 serving to seal the mechanical connection and additionally to absorb any resulting mechanical vibrations of the said sub assembly 8, 22, 18.

In practice it has been found that with the system shown and described it is perfectly possible to make use of loudspeakers 8 and 18 adapted for reproduction of both the lowermost and the middle range frequences, whereby it is possible to avoid the use of correspondingly specialized loudspeakers as well as an associated electrical cross-over unit.

The rearmost chamber 16 should not necessarily be entirely closed, inasfar as it may have an opening such as a rearwardly directed acoustical port. Obviously, the said qualification of the closed chamber will then be reduced, but, some other qualified combination effect of the two chambers may still be possible. In general, experiments and calculations have shown that the double chamber design with the two antiphase loudspeakers offers many advantageous possibilities based on modifications of the several parameters as constituted by the volumes of the two chambers, the type or types of the two loudspeakers, and the location and size of the acoustic port of at least the front plate. An important finding is that the closed rear chamber as accounting for a remarkably good bass reproduction may show this effect for a volume, which is considerably smaller than the volume correspondingly required for a pure or single chamber closed type system.

It should be mentioned that it has been found advantageous to use a rear loudspeaker 18, in which the resilient suspension of the movable system is softer than in the front loudspeaker 8.

Principally, in order to obtain the advantages of the double chamber system as far as the sound reproduction is concerned, the two or at least two loudspeakers 8 and 18 should not necessarily be located on a common center axis; thus, the loudspeaker 18 could be located on the top plate of the chamber 20 cooperating with an upper closed chamber. It will be appreciated, however, that the requirement of the two loudspeakers working together for producing the sound in the chamber 20 automatically results in a mechanical antiphase operation when the loudspeakers are arranged on a common axis, whereby the additional and very important advantage of an overall non-vibrating loudspeaker cabinet is achieved.

Figure 3:
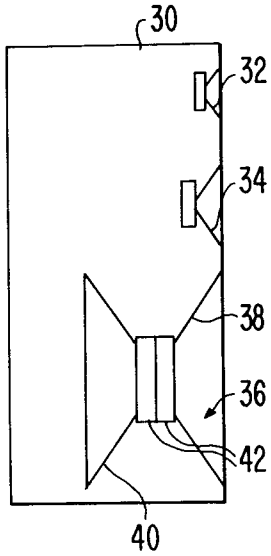
FIG. 3 is a schematic sectional view of a loudspeaker cabinet provided with a loudspeaker system according to the invention.

In FIG. 3 is shown a loudspeaker cabinet 30, the front plate of which carries a tweeter 32, an intermediate loudspeaker 34, and a woofer unit 36 comprising a front radiating woofer 38 and another corresponding woofer 40, which is arranged back to back with the woofer 38, with the magnetic systems 42 engaging and secured to each other. When the magnetic systems are uniformly polarized in the joined woofers the polarizations will be opposite adjacent the meeting plane between the woofers, and as already mentioned this will induce an increase of the magnetic flux in the annular air gaps for the voice coils of both of the woofers.

The two woofers 38 and 40 are electrically coupled in phase, whereby the back to back arrangement will involve that the respective voice coils and diaphragms will operate in counterphase, such that the unit will not transfer noticeable oscillations to the cabinet.

Figure 4:
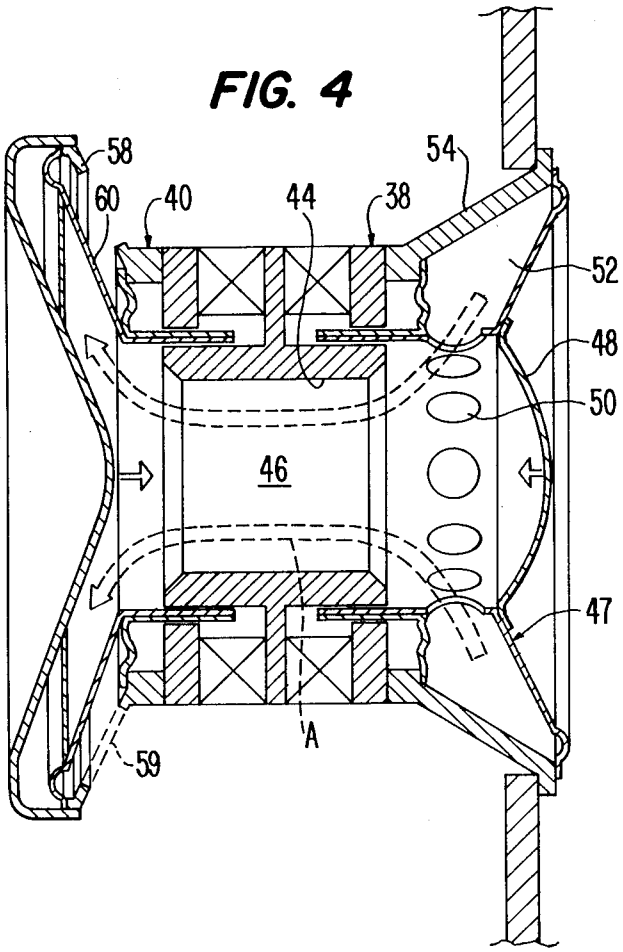
FIG. 4 is a more detailed sectional view of the woofer system comprising two acoustically series connected woofers.
Figure 13:
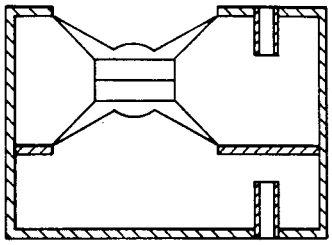
FIGS. 9–18 are schematical views illustrating different possible manners of arranging a loudspeaker unit according to the invention in a cabinet.
Figure 12:
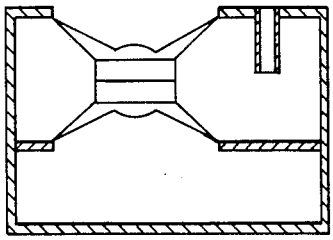
Figure 11:
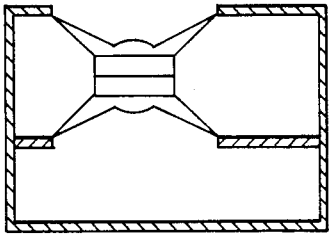
Figure 10:
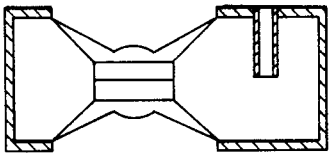
Figure 9:
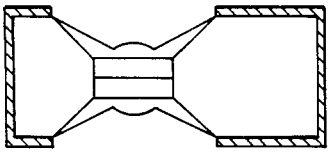
Figure 14:
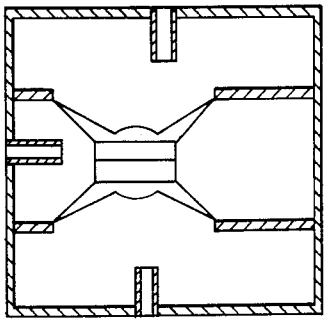
Figure 15:
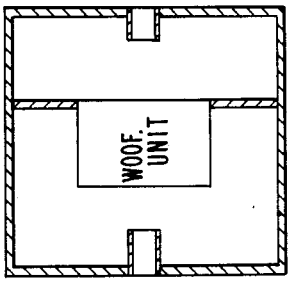
Figure 16:
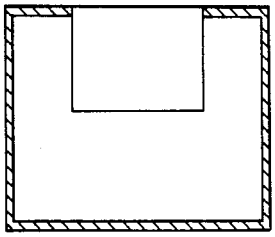
Figure 17:
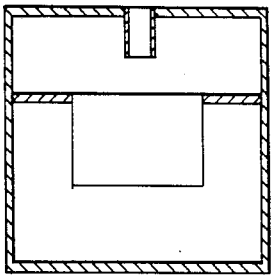
Figure 18:
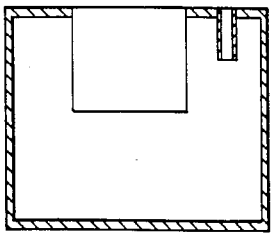

FIG. 4 shows the two woofers arranged acoustically in series. The woofers are special in that the central pole pieces of their magnetic systems are shaped as a tube 44, such that a rather wide internal air channel 46 is provided between the diaphragm areas of the woofers. The diaphragms 47 of the front woofer is entirely closed, the front end of the associated voice coil cylinder being closed by a central diaphragm portion 48, while the voice coil cylinder inside the diaphragm is provided with an annular row of holes 50 open towards an outer space 52 behind the diaphragm 47. The woofer chassis, designated 54, constitutes a closed cone, such that the space 52 is a closed space.

The rear woofer 40 is provided with a rigid, rearmost wall member 56, which is circumferentially sealed to the chassis 58 of this woofer, such that behind the diaphragm 60 thereof a space or chamber 62 is confined. In this woofer the voice coil cylinder is not covered by any diaphragm portion, i.e. the otherwise closed chamber 62 is in open connection with the air channel 46. The outer diameter of the diaphragm 60 is slightly larger than the outer diameter of the diaphragm of the front woofer 38, whereby the lacking diaphragm portion across the voice coil cylinder is compensated for. The rear chassis 58 is perforated through openings 59 in such a manner that the front side of the diaphragm 60 is in open connection with the air inside the cabinet 30.

In operation the opposed diaphragms 47 and 60 will be moved towards and away from each other, and arrows A in FIG. 4 illustrate the associated air flow when the diaphragms are moved towards each other. Hereby the air in the foremost chamber 54 as well as behind the central diaphragm portion 48 will be compressed, while at the same time the rear chamber 62 will expand, whereby the air will flow rearwardly in the system, through the central channel 46. When the diaphragms move inversely a corresponding air flow will be created in the opposite direction, and during the operation the air may thus pulsate from one side to the other without meeting any substantial resistance. It will be appreciated that this corresponds to the operative characteristics of the said known compound systems, in which the foremost diaphragm is relieved from the air spring action on the rear side thereof as well as from the distorting, direct contact with the air inside the cabinet; by the invention this contact is established to the front side of the rear diaphragm 60. Still, the decisive advantage of the system will be that it does not create considerable external oscillations, and that the tight juxtaposition of the two magnetic systems will account for an increased flux intensity in the annular operation gaps of the voice coils.

It is highly advantageous, but not really necessary that the flow connection between the chambers 52 and 62 be established centrally through the magnetic systems of the loudspeakers; thus, as examplified further below it will be within the scope of the invention to make use of one or more external connections between these chambers.

Figure 5:
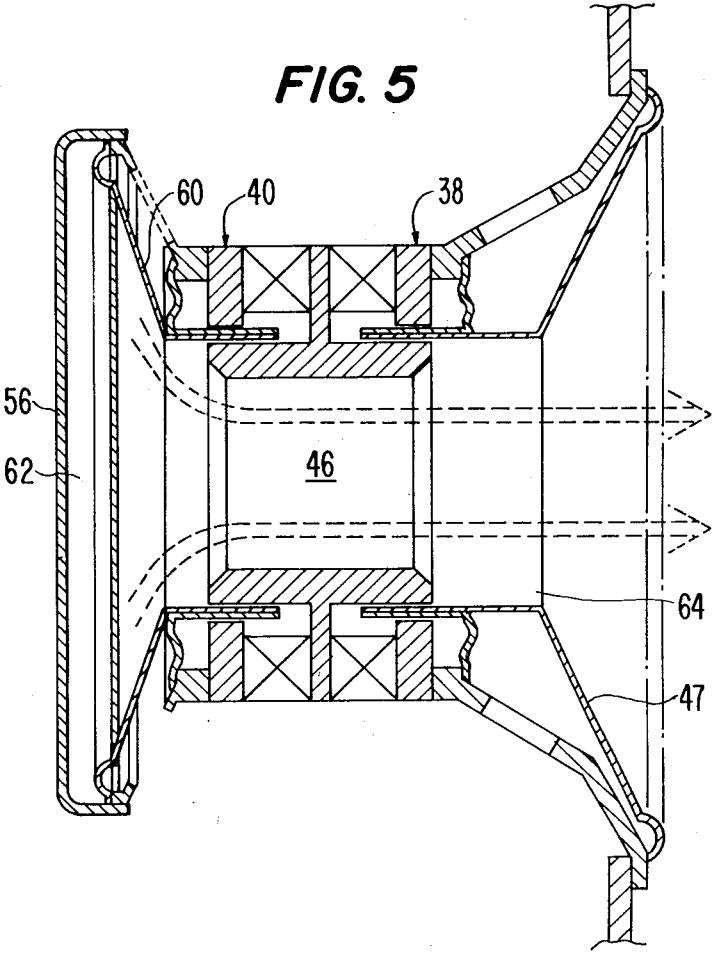
FIG. 5 is a corresponding sectional view of two acoustically parallel connected woofers.

FIG. 5 illustrates a widely similar combination of the two woofers, though here with the woofers interconnected in parallel, acoustically. The central portion 48 (FIG. 4) of the front woofer is here removed, such that the central channel 46 is forwardly open. The chassis 54 of the front woofer is perforated behind its diaphragm 47, as shown by holes 55, such that the rear side of this diaphragm is in open connection with the air in the cabinet 30. The rear woofer is designed principally as shown in FIG. 4, though here with the rigid rear wall shaped as a planar member, without the cone shaped depression as shown in FIG. 4; with this shape of the wall in FIG. 4 it is intended to adapt the volume of the chamber 62 to the volume of the front chamber 52, which is irrelevant in connection with FIG. 5.

When the foremost diaphragm 47 in FIG. 5 is moved forwardly so as to compress the front air the rear diaphragm will be moved rearwardly, which will result in a compression of the air in the chamber 62. Hereby the air will flow out forwardly through the passage 46 so as to be front radiated in phase with the air as pushed forwardly by the foremost diaphragm 47. Correspondingly, air will be drawn rearwardly through the passage 46 when the rear diaphragm is moved forwardly, while also the front diaphragm 47 will create a vacuum on the outer air in response to being moved rearwardly.

The central passage 46 may well be considered "narrow" compared with the outer diameters of the woofer diaphragms, i.e. the associated sound hole, designated 64, is relatively small, but since the space or chamber 62 behind the sound hole is of a large diameter the air pulsations in and out through the sound hole will be considerably stronger than corresponding to the pulsations in front of a diaphragm portion of the size of the sound hole, i.e. a remarkable increase of the sound pressure of the front woofer will be achieved.

Since both of the diaphragms 47 and 60 are in open connection with the interior of the cabinet the volume of the cabinet should be correspondingly large, but the woofer unit according to the invention still presents the advantage that the double woofer on the front side of the cabinet will occupy the mounting space of a single woofer only, just as the unit will additionally be advantageous with respect to suppressed cabinet oscillations and improved efficiency of the magnet systems of the woofers.

Also the embodiment of FIG. 5 may be modified by renouncing the central air passage 46 and submitting therefor some corresponding external channel connection. Thus, the chamber 62 may be connected to a separate acoustic port on the front side of the cabinet 30 through one or more internal channels, and it is hereby even possible to avoid the inevitable resistance effect of the narrow central channel 6, just as it will be possible to increase the effective area of the front diaphragm 47 by the central portion 48 as in the embodiment according to FIG. 4.

In practice the double woofer unit should not necessarily be constituted by two separate, built-together woofers, as the unit may be designed as a single integrated construction. In such an integrated unit as suggested already in FIG. 5 it may be considered to renounce the said advantage of a close juxtaposition of two separate magnetic systems and instead make use of a single magnetic system having the required two associated annular voice coil gaps, inasfar as the simplicity of such a system might well justify the use of a magnetic system of a strength sufficiently high to create strong flux fields in the annular gaps without the use of any external magnetic influence.

Figure 6:
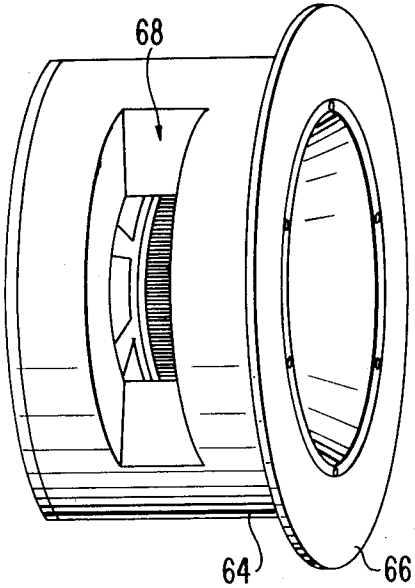
FIG. 6 is a perspective view of a woofer unit according to the invention.

In FIG. 6 is shown a double woofer unit of the disclosed type comprising two woofers joined back to back and surrounded by a cylindrical casing 64 having a front mounting flange 66. The casing 64 is open at both ends and is provided with opposed side openings 68, through which the space between the interfacing sides of the front and rear woofer diaphragms is connectable with outer space or channel means.

Figure 8:
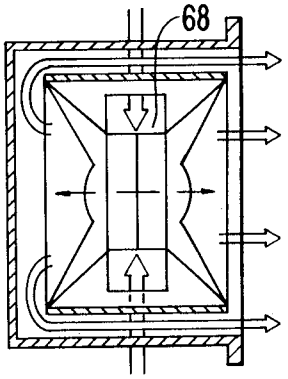
FIGS. 7 and 8 are respective orthogonal sectional views thereof.
Figure 7:
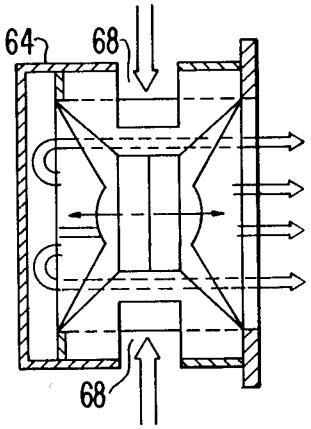

This unit is mountable in a cabinet as shown in FIGS. 7 and 8, seen from respective orthogonal angles, such that the lateral openings 68 are open towards the internal of the cabinet, while the space behind the rear diaphragm is flow connected, inside the casing 64, with the space behind the rear side of the front diaphragm, corresponding to the embodiment of FIG. 4, though now with external connecting channel means in stead of the central passage 46.

Of course, the unit shown in FIG. 6 could well be designed in accordance with FIG. 5 so as to present a central sound hole in the front diaphragm 47. Alternatively, the rear side of same unit will be connectable throuth external channel means to an acoustic port of the cabinet.

The mounting possibilities of the double woofer unit are further illustrated in FIGS. 9–18, which are believed to be self-explanatory. These figures show different constellations of the woofer unit as associated with various wall portions of the loudspeaker cabinet, with the latter having various internal designs, some of which comprises one ore more tubular acoustic ports. In FIGS. 15–18 the schematically indicated loudspeaker unit may be of a type as shown in either of the FIGS. 2 and 3.

In the additional embodiments, the first and second loudspeakers are designed for effective reproduction of both bass and middle tone frequencies, such that the unit constitutes a so-called two-way unit including only a single crossover-network.

What is claimed is:

1. A loudspeaker unit for a reproduction of at least sound of low frequencies, the loud speaker unit comprising a cabinet provided with two low frequency loudspeakers, with a first low frequency loudspeaker mounted on a front plate of the cabinet, and with the front plate including an acoustic port spaced from the location of the front plate mounted low frequency loudspeaker, characterized in that the second low frequency loudspeaker is mounted on an internal partition plate behind the first front mounted low frequency loudspeaker and is electrically connected so as to operate, geometrically, in counter phase with the first low frequency loudspeaker, such that the two low frequency loudspeakers cooperate to produce sound in a front chamber between the front plate and the internal partition plate, said second low frequency loudspeaker cooperating rearwardly with a closed or substantially closed chamber located between the internal partition plate and a rear wall of the cabinet.

2. A loudspeaker unit according to claim 1, in which the two low frequency loudspeakers are arranged back to back on a common axis and are rigidly interconnected by connector means resistant both to axial compression and pulling forces.

3. A loudspeaker unit according to claim 2, in which the two rigidly interconnected low frequency loudspeakers are respectively individually connected to the front plate and internal partition plate by resilient sealing means.

4. A loudspeaker unit according to claim 1, in which the first and second loudspeakers are generally of identical construction, with the resilient suspension of the movable system of the second loudspeaker being softer than that of the first loudspeaker.

5. A loudspeaker unit according to claim 1, in which the front plate additionally carries a tweeter, and in which the said first and second low frequency loudspeakers are designed for effective reproduction of both bass and middle tone frequences, such that the loudspeaker unit constitutes a so-called two way unit including only a single crossover-network.

6. A compound type loudspeaker system comprising two substantially similar loudspeakers mounted in a loudspeaker cabinet and cooperating to reproduce primarily the bass frequency range, each speaker having a diaphragm and a magnetic drive system including a voice coil, characterized in that the two loudspeakers are arranged back-to-back, with the respective magnetic drive systems of the two loudspeakers facing each other and being mechanically rigidly secured to each other, the respective voice coils of the two loudspeakers being electrically connected so as to oscillate geometrically in counter phase, towards and away from each other, the respective spaces in front of and behind the respective diaphragms of the loudspeakers being connected such that the loudspeakers acoustically cooperate in series or parallel, and in which the space lying to an exterior side of the diaphragm facing the rear of the loudspeaker cabinet is concealed from air inside the cabinet and is flow connected with either an acoustic port in the diaphragm facing the front side of the loudspeaker cabinet, or in the loudspeaker cabinet itself, or with an otherwise closed space behind the diaphragm facing the front of the loudspeaker cabinet.

7. A loudspeaker sytstem according to claim 6, in which the flow connection extends through the central portion of the magnetic systems of the loudspeakers.

8. A loudspeaker system according to claim 6, in which the flow connection extends externally outside the juxtaposed or integrated magnetic systems.

* * * * *